US005596393A

United States Patent [19]

Kobayashi et al.

[11] Patent Number: 5,596,393

[45] Date of Patent: Jan. 21, 1997

[54] IMAGE FORMING APPARATUS HAVING CHARGING MEMBER SUPPLIED WITH OSCILLATING VOLTAGE

[75] Inventors: Tatsuya Kobayashi, Sohka; Hiroshi Sasame, Yokohama; Tetsuya Kobayashi, Kawasaki; Toshiaki Miyashiro, Ichikawa, all of Japan

[73] Assignee: Canon Kabushiki Kaisha, Tokyo, Japan

[21] Appl. No.: 172,711

[22] Filed: Dec. 27, 1993

[30] Foreign Application Priority Data

Dec. 26, 1992 [JP] Japan ..... 4-359588

[51] Int. Cl.[6] ..... G03G 15/02

[52] U.S. Cl. ..... 399/174; 361/225; 399/89; 399/298

[58] Field of Search ..... 355/219, 326 R, 355/327; 361/225, 221

[56] References Cited

U.S. PATENT DOCUMENTS 4,851,960 7/1989 Nakamura et al. ..... 361/225
4,949,125 8/1990 Yamamoto et al. ..... 355/219
5,034,777 7/1991 Ohzeki et al. ..... 355/274
5,151,736 9/1992 Ohzeki et al. ..... 355/208
5,386,286 1/1995 Kinouchi et al. ..... 355/326 R

FOREIGN PATENT DOCUMENTS 57-148765 9/1982 Japan .
62-299872 12/1987 Japan .

*Primary Examiner*—Shuk Yin Lee
*Attorney, Agent, or Firm*—Fitzpatrick, Cella, Harper & Scinto

[57] ABSTRACT

An image forming apparatus includes image bearing member or members for bearing an image; charging member for sequentially charging a surface of the image bearing member or members to form an image thereon; a voltage source for applying an oscillating voltage to the charging member, the oscillating voltage including a first frequency and a second frequency which is different from the first frequency during charging by the charging member.

22 Claims, 6 Drawing Sheets

IMAGE FORMING APPARATUS HAVING CHARGING MEMBER SUPPLIED WITH OSCILLATING VOLTAGE

FIELD OF THE INVENTION AND RELATED ART

The present invention relates to an image forming apparatus having a charging member supplied with an oscillating voltage to charge an image bearing member such as a photosensitive member or a dielectric member.

Heretofore, a corona discharging device has been widely used as charging means for an image bearing member. Recently, however, a contact type charging means has been put into practice by which a charging member (charger) supplied with a voltage is contacted to the image bearing member to charge the image bearing member, because it is advantageous in that the corona product such as ozone or the like is small as compared with a corona charger, and the level of the applied voltage is low and so on.

The voltage applied to the charging member is an oscillating voltage in the form of an AC biased DC voltage.

Although the contact charging supplied only with a DC voltage is advantageous in that the level of the applied voltage is low, and that the structure of the voltage source is simple and inexpensive. However, it involves this advantages that spot-like charging non-uniformity tends to occur, and it is easily influenced by contamination of the charging member and therefore, the latitude within the uniform charging is small.

Contrary thereto, the contact charging using the oscillating voltage is advantageous in that the spot-like non-uniformity can be significantly removed and the latitude within the uniform charging is large although the structure of the voltage source is a little complicated and expensive as compared with the contact charging using only DC voltage. As disclosed in U.S. Pat. No. 4,851,960, the oscillating voltage is preferably has an AC component having a peak-to-peak voltage which is not less than twice as large as the charge starting voltage for the image bearing member.

In an image forming apparatus in which the image bearing member is charged by application of the oscillating voltage to the charger and in which a latent image is formed along a scanning line on the image bearing member, there is a problem of image non-uniformity as a result of interference of the spatial frequency of the latent image projected and formed on the image bearing member and a charging frequency for the image bearing member due to the frequency of the oscillating voltage. More particularly, because of the fine potential change in accordance with the frequency of the oscillating voltage applied to the charger, the interference results in non-uniform pitch or moire when an image having a spatial frequency close to the frequency of the oscillating voltage is formed.

In an image forming apparatus having a high resolution as a laser beam printer, halftone images are sometimes produced. The halftone images are frequently provided by horizontal lines, longitudinal lines, dots or the like which involve spatial frequency. When the image corresponding to the image information having the spatial frequency is projected, the periodic nature due to the charging and the periodic nature of the image information are interfered with each other with the result of non-uniform pitch or moire or another image disturbance having small period in the longitudinal or horizontal direction or directions.

When a color image is formed by repeated image forming process including charging the image bearing member with the use of the oscillating voltage applied to the charger, pitch non-uniformity, moire and color non-uniformity of the image result for the respective color components (yellow, magenta, cyan and black (four colors)) to be superimposed sequentially.

Even the periodical image disturbance which is not highly notable in monochromatic image, is enhanced if a plurality of images are superimposed with the result of significant deterioration of the image quality.

SUMMARY OF THE INVENTION

Accordingly, it is a principal object of the present invention to provide an image forming apparatus in which the charge non-uniformity of the image bearing member by the charging member is suppressed.

It is another object of the present invention to provide an image forming apparatus in which pitch non-uniformity or moire is suppressed in the resultant image.

It is a further object of the present invention to provide an image forming apparatus in which color non-uniformity in the plurality of images is suppressed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
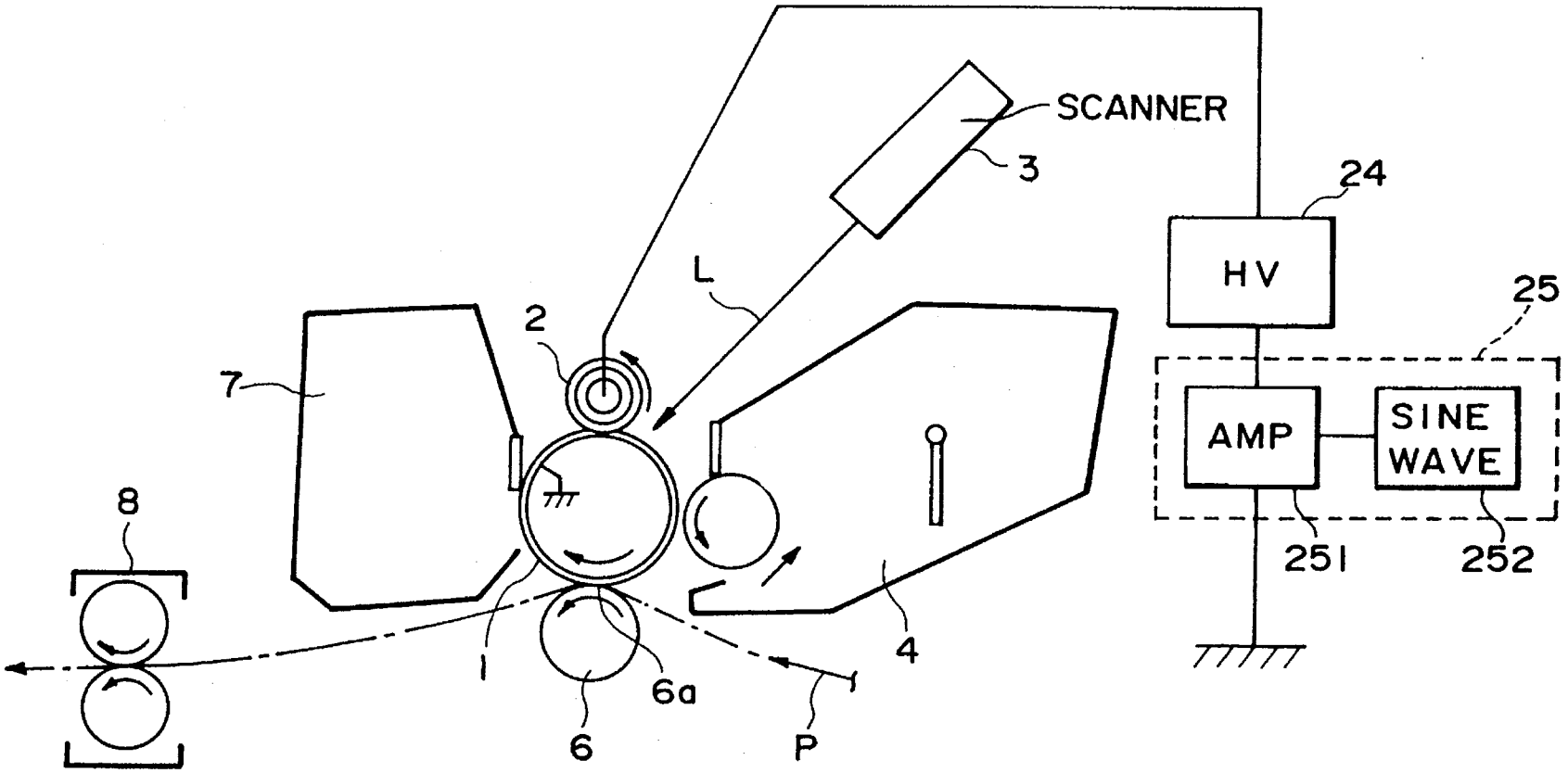
FIG. 1 is a sectional view of an image forming apparatus according to a first embodiment of the present invention.

Referring to FIG. 1, there is shown a laser beam printer of an image transfer and electrophotographic type as an exemplary image forming apparatus according to a first embodiment of the present invention.

An image bearing member 1 is an electrophotographic photosensitive member of a rotatable drum type, which will hereinafter be called "photosensitive drum". It comprises an electrically grounded aluminum cylinder, on the outer peripheral surface of which an organic photoconductor (OPC) or A—Si (amorphous silicon), Cds, SA or another inorganic photoconductive layer is formed. It is rotated at a predetermined peripheral speed (process speed) in the clockwise direction indicated by an arrow by an unshown driving means.

A contact charging roller 2 (charger) is driven by the photosensitive drum 1. As will be described hereinafter, a predetermined high voltage is applied thereto from a high voltage source 24 and 25. By doing so, the peripheral surface of the rotating photosensitive drum 1 is uniformly charged to the predetermined polarity and potential.

The thus charged surface of the photosensitive drum is exposed to the information image light L by a laser scanner 3 as an exposure device, by which an electrostatic latent image corresponding to the image information is formed on the surface of the rotating photosensitive drum 1.

The latent image is developed by a developing device 4 into a toner image. In this embodiment, a reverse development is used in which the charging polarity of the toner is the same as the charging polarity of the charger. The toner image is transferred onto a surface of the transfer material P supplied at a predetermined timing from a sheer feeding station (not shown), at a transfer nip *6a* formed by a transfer roller 6 and the photosensitive drum 1. A transfer bias voltage having a polarity opposite from the charging polarity of the toner is applied to the transfer roller 6.

The transfer material *6a* having received the toner image at the transfer nip *6a* is introduced into the fixing apparatus 8, where the toner image is fixed into a permanent image. Then, it is discharged as a print or copy.

The surface of the photosensitive drum 1 after the toner image transfer onto the transfer material P is cleaned by a cleaning device 7 so that the residual toner or the like is removed, and is repeatedly used for image formation.

Figure 2:
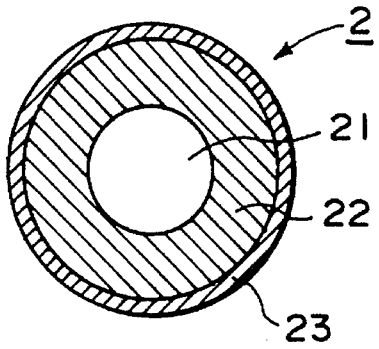
FIG. 2 is a sectional view illustrating a layer structure of a charging roller.

The charging roller 2 in this embodiment, as shown in FIG. 2, is provided with an electrically conductive elastic layer 22 of EPDM (ethylene propylene dien terpolymer), NBR (nitrile butadiene rubber), silicone rubber or the like, On the outer peripheral surface of the conductive elastic layer 22, and on the outer peripheral surface of the conductive elastic layer 22, an urethane rubber layer 23 having a volume resistivity of $10^5$ ohm.cm by dispersion of carbon is provided.

A core metal 21 of the charging roller 2 is connected with a series of DC high voltage source 24 and an AC voltage source 25 which produces sine wave voltage, so that the charging roller 2 is supplied with an oscillating voltage which is a voltage having a periodically changing voltage.

The AC voltage source 25 comprises an AC voltage amplifier 251 and a sine wave generator 252 capable of frequency modulation. A signal produced by the sine wave generator 252 is amplified by an AC high voltage amplifier 251, so that a predetermined bias voltage is applied to the charging roller 2.

Figure 3:
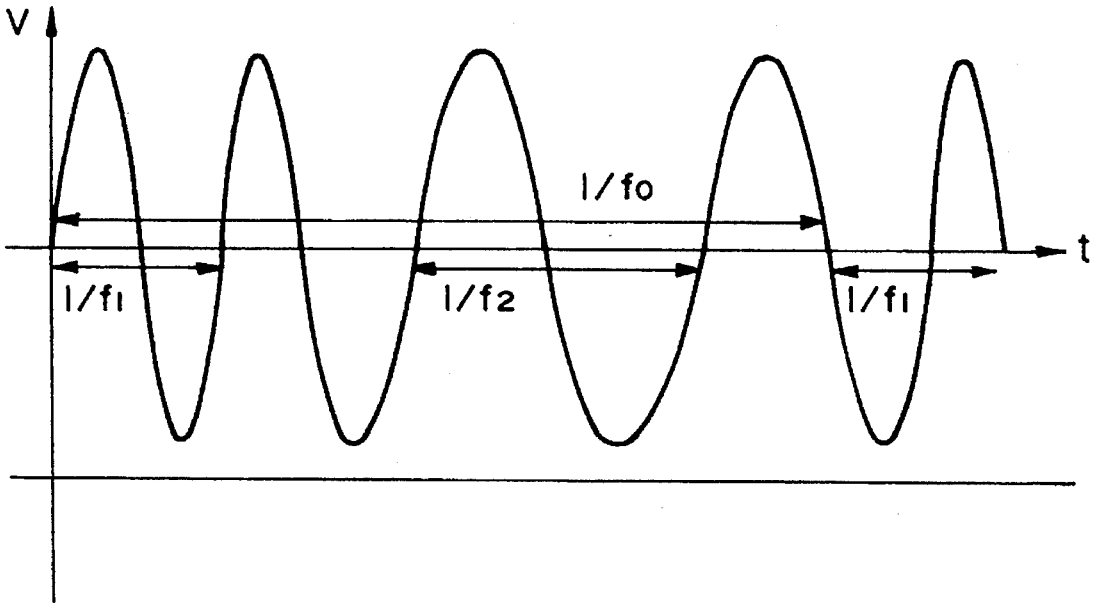
FIG. 3 shows a waveform of an applied bias voltage to the charging roller.

FIG. 3 shows an output waveform of the voltage provided by the AC source. During one image formation, it is modulated from the maximum frequency f1 through the minimum frequency f2 to the maximum frequency f1 during the charging operation for one image formation. Modulated (combined) frequency is indicated by f0 which comprises a plurality of different frequencies, and takes the same voltage level for each 1/f0 sec (period). Here, if the maximum frequency f1 is too high, the current consumption will be increased, and the charging noise will be increased. If the minimum frequency f2 is too low, the charge non-uniformity results, and therefore, they are preferably not more than 2000 Hz and not more than 200 Hz although, they should be properly determined by one skilled in the art depending on the process speed Vps (μm/sec) of the photosensitive drum in the used apparatus.

The difference between the maximum frequency f1 and the minimum frequency f2 is preferably not less than 50 Hz, and further preferably not less than 100 Hz, because then preferable were provided. The modulation frequency f0 is preferably has not less than 3 waves, preferably not less than 5 waves, in the period thereof, since then the preferable results are obtained. It is preferably not more than 600 Hz. Here, one wave means the form including one top peak and one bottom peak. If the modulation frequency f0 is too low, the change of the frequency becomes slow with the result of less effectiveness of the modulation. Therefore, it is preferably not more than 10 mm and further preferably not more than 5 mm. In other words, the preferably range is not more than 10 mm/Vps (sec), further preferably 5 mm/Vps (sec).

As regards the charging bias to the charging roller 2 in the printer of this embodiment, the investigation has been made as to the production of moire in a line image comprising one-dot with lines with 1–4 dot width gaps between adjacent lines, under the condition that the maximum frequency f1 is 600 Hz, the minimum frequency f2 is 400 Hz, and the modulation frequency f0 in 122 Hz. As a comparison example, the charging frequency is maintained constant at 500 Hz, and the moire production is investigated in the similar manner. In both cases, the process speed was 100 mm/sec, and the resolution was 600 dpi. The results are shown in Table 1. In the Table, 1 dot 1 dot space, for example, means the formation of a line image by repeating 1 dot line scan by the laser beam with 2 dot non-scanned lines.

TABLE 1

| | Embodiment | Comp. Ex. |
|---|---|---|
| 1 dot 1 space | G | G |
| 1 dot 2 spaces | G | G |
| 1 dot 3 spaces | C | F |
| 1 dot 4 spaces | G | N |

G: No moire
F: Slight degree of moire
N: Remarkable moire

As will be understood from the above results, a slight degree of moire is produced in the case of 1 dot 3 spaces, and the remarkable moire is produced in the case of 1 dot 4 spaces. According to this embodiment, however, no moire is produced in any images.

When the charging frequency was varied in the Comparison Example while maintaining the charging frequency is maintained during the charging operation, the moire was produced in the case of at least one of the types of the above images, if the frequency exceeds 500 Hz.

As described in the foregoing, by modulating during the charging the frequency of the oscillating voltage applied to the charger 2, a high quality images can be produced without moire. The charger 2 may be in the form of charging blade, charging brush or the like rather than the charging roller.

Embodiment 2

Figure 4:
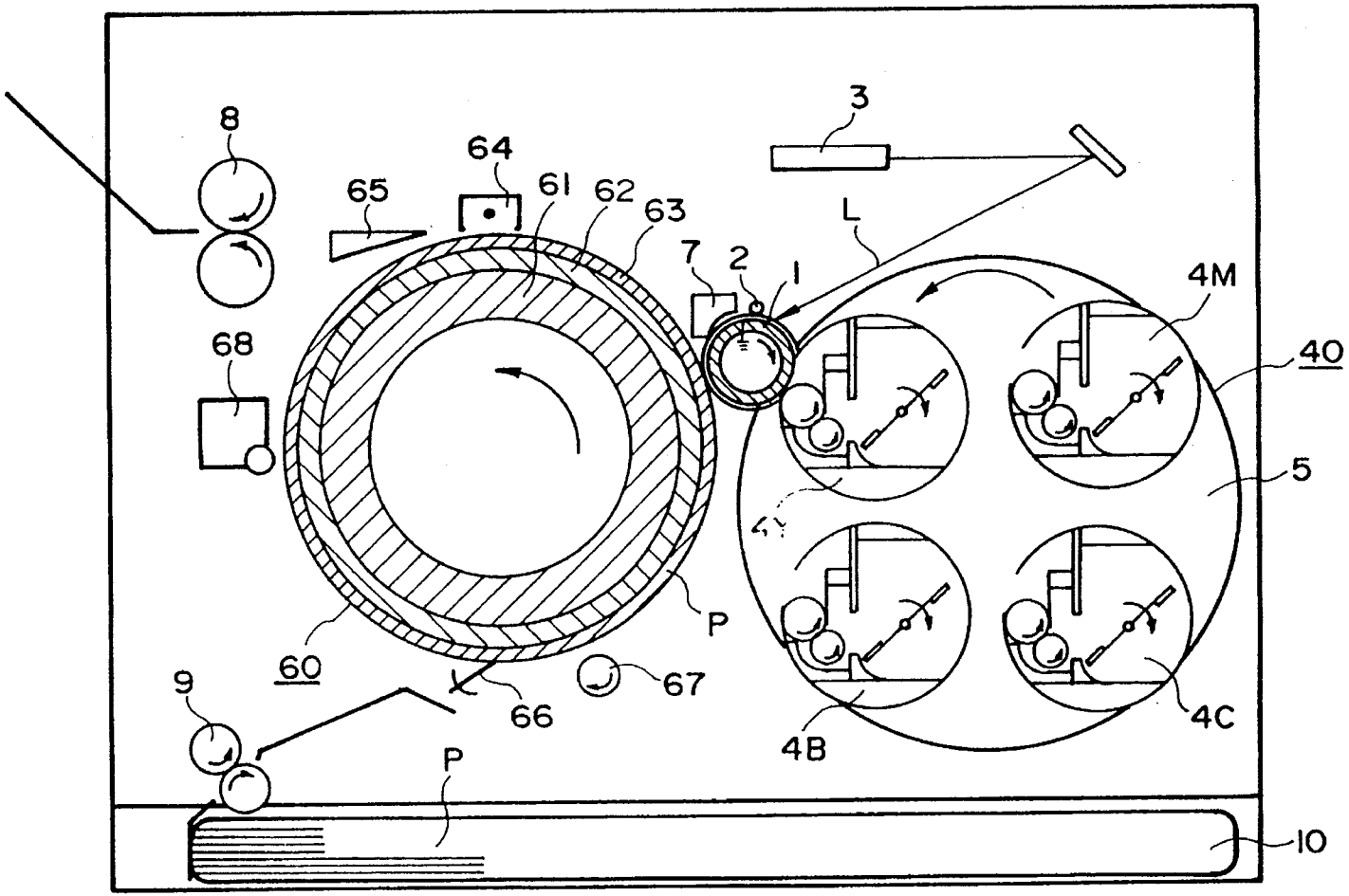
FIG. 4 is a sectional view of a color image forming apparatus according to a second embodiment of the present invention.

Referring to FIG. 4, there is shown an image forming apparatus according to a second embodiment of the present invention, in which the image forming apparatus is a color image forming apparatus.

The rotatable photosensitive drum as the image bearing member is uniformly charged to a predetermined potential by the charging roller 2 as the charger. The charging roller 2 is connected to high voltage sources 24 and 25 (FIG. 1) similarly to the case of the first embodiment, although not shown in FIG. 4.

A signal in accordance with a yellow component image pattern of the intended color image is supplied to an exposure device (laser scanner) 3, and the photosensitive drum 1 is exposed and scanned with the light L bearing the image. By this, a latent image is formed on the photosensitive drum 1.

In a turret type rotatable developing device 40, a developing device 4Y containing yellow toner is faced to the photosensitive drum by rotation of the supporting member. By the developing device 4, the latent image is visualized into a yellow toner image on the photosensitive drum 1. The yellow toner image is transferred onto a transfer sheet P supported and wrapped on the outer peripheral surface of the transfer drum 60.

The toner image is transferred onto the transfer material P in the following manner. A transfer material P is fed to the transfer drum 60 by a pick-up roller 9 from the transfer sheet cassette 10 in synchronism with the toner image on the photosensitive drum 1. The transfer drum 60 comprises an electroconductive supporting member 61 and an elastic laser 62 thereon, and a dielectric sheet 63 stretched on the elastic layer 62. It is rotated in the counterclockwise rotation as indicated by an arrow substantially at the same speed as the photosensitive drum I. When the transfer sheet P is supplied to the transfer drum 6, a leading edge of the transfer sheet is supported by a gripper 66 mounted on a part of the supporting member. The transfer sheet is further electrostatically attracted by an attraction device 67 comprising an attraction roller. The transfer sheet is wrapped around the transfer drum 60. The toner image on the transfer drum 1 is transferred onto the transfer sheet P supported on the transfer drum 60 by application of a bias voltage of a polarity opposite from that of the toner 60. Subsequently, the following operations are carried out: latent image formation of a magenta component image pattern of the intended color image, development by a developing device 4M containing magenta toner, transfer of the magenta toner image onto the transfer sheet; latent image formation for the cyan component image pattern, development by a developing device 4C containing cyan toner, transfer of the cyan toner image onto the transfer sheet; latent image formation for a black image pattern, development by a developing device 4B containing black toner, and the transfer of the black toner image onto the transfer sheet. By doing so, the four toner images, namely, yellow toner image, magenta toner image, cyan toner image and black toner image are sequentially superimposedly transferred onto the same side of the same transfer material wrapped around the transfer drum 40. Thus, the intended color toner image is formed on the transfer material P.

The transfer material P having received the superposed image, is separated from the transfer drum 60 by a separation charger 60 and separation claws 65. It is then fed to a heat fixing device 8, wherein it is fixed into a permanent image by being fused and mixed. Finally, it is discharged to the outside of the apparatus.

The toner remaining on the photosensitive drum after the image transfer is removed by a cleaning device 7. As desired, the toner on the transfer drum 60 may be removed by a transfer drum cleaning device 68 such as far brush, web or the like.

In the color image forming apparatus described above, a color image is formed by overlying the four different color toner images (yellow, magenta, cyan and black), and therefore, non-uniform color appears in some cases in addition to the pitch non-uniformity in the component monochromatic images.

More particularly, when the same frequency and same phase are used in the primary charging by the charging roller, the charging non-uniformity and the density non-uniformity due to it, is overlaid with each other such that the color non-uniformity appears even if the density uniformity in the component monochromatic image is tolerable. More particularly, when the color image is formed under the same conditions as in the comparison example in Table 1 as described in conjunction with Embodiment 1, the color non-uniformity appeared in 1 dot space image with which the moire is not produced in the monochromatic image. When the charging frequency for the respective color is the same, but the phase of the frequency is made different for the respective colors, or the charging frequencies for the respective colors are made different, the color non-uniformity problem has been solved. More particularly, the phase or the frequency of the high voltage source of the charging roller is made changeable, and the image writing timing for each of the different color images, is changed for each of the detected signals, by which at least one of the phase and the frequency is switched. Similarly to the first embodiment, the frequency of the primary bias voltage is modulated in the charging operation for one color, by which the moire and the color non-uniformity can be prevented in the color image formation as well as the monochromatic image formation. The primary charging bias voltage to the charging roller 2 in each of the toner image forming processes, was set as follows.

Figure 5:
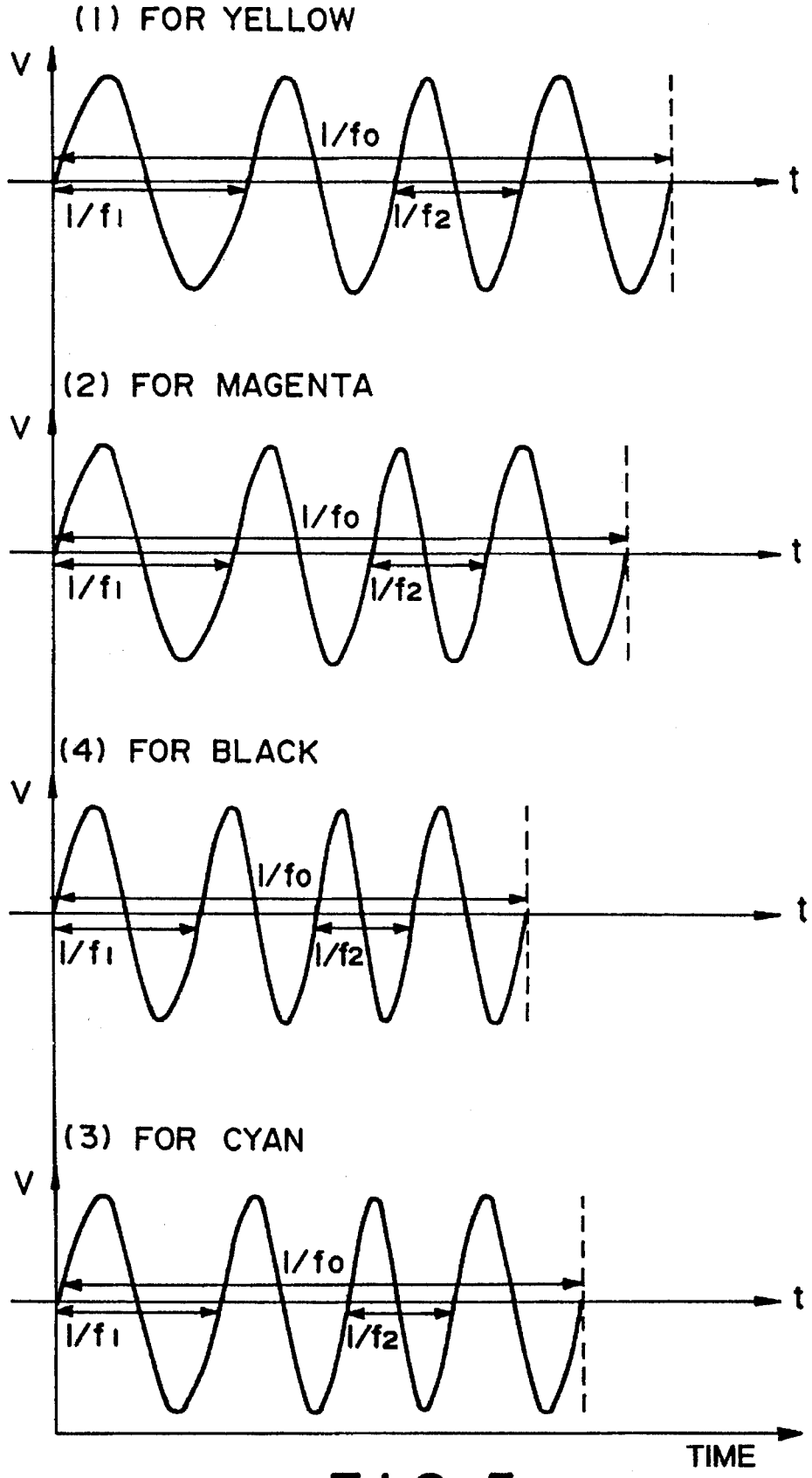
FIG. 5 shows a waveform of a bias voltage applied to the charging roller in a toner image forming process for each of colors.

(1) First color yellow toner image formation process:

As shown in FIG. 5, (1) the minimum frequency f1 was 400 Hz, and the maximum frequency f2 was 600 Hz.

(2) Second color magenta toner image formation process:

As shown in FIG. 5, (2), the minimum frequency f1 was 450 Hz, and the maximum frequency f2 was 650 Hz.

(3) Third color cyan toner image formation process:

As shown in (3) in the same Figure, the minimum frequency f1 was 400 Hz, and the maximum frequency f2 was 700 Hz.

(4) Fourth color black toner image formation process:

As shown in (4) of the same Figure, the minimum frequency f1 was 500 Hz, and the maximum frequency f2 was 750 Hz.

The frequency f0 is set such that four waves were contained in one period.

The output images were compared among the above-described embodiment, Comparison Example 1 and Comparison Example 2. In Comparison Example 1, the charging frequency was not changed and maintained at 500 Hz for each of the toner image formation processes. In Comparison Example 2, the same bias conditions in the first embodiment were used for the respective color toner image formation processes. The used images were the same line images as in the first embodiment. Both of monochromatic images and full-color images were outputted. The results are shown in the following Table 2.

TABLE 2

| | Embodiment | | Comp. Ex. 1 | | Comp. Ex. 2 | |
|---|---|---|---|---|---|---|
| Image | Mono | Color | Mono | Color | Mono | Color |
| 1 dot 1 space | G | G | G | F (non-uniformity) | G | F (non-uniformity) |
| 1 dot 2 spaces | G | G | G | F (non-uniformity) | G | F (non-uniformity) |
| 1 dot 3 spaces | G | G | F | F (non-uniformity) | G | F (non-uniformity) |
| 1 dot 4 spaces | G | G | n | n (non-uniformity) | G | F (non-uniformity) |

As will be understood from the results, no moire was produced in monochromatic or color image formations in this embodiment.

In Comparison Example 1, slide degree of moire is produced in the case of 1 dot 3 spaces in the monochromatic image and color image, and the moire was remarkable in the case of 1 dot 4 spaces. Particularly in the case of color image, the moire appears as color non-uniformity, with the result of remarkable deterioration of the image quality.

In Comparison Example 2, the moire is not produced in the monochromatic image. However, in the case of the color image, the color non-uniformity is produced although the degree thereof is not so bas as in Comparison Example 1.

As described in the foregoing, in a color image forming apparatus in which the color image is formed by repetition of charging, exposure, development and transfer steps on a photosensitive drum, the moire and the color non-uniformity can be prevented in a color image by changing the frequencies for the colors and by changing the frequency of the bias applied to the charging roller.

Figure 6:
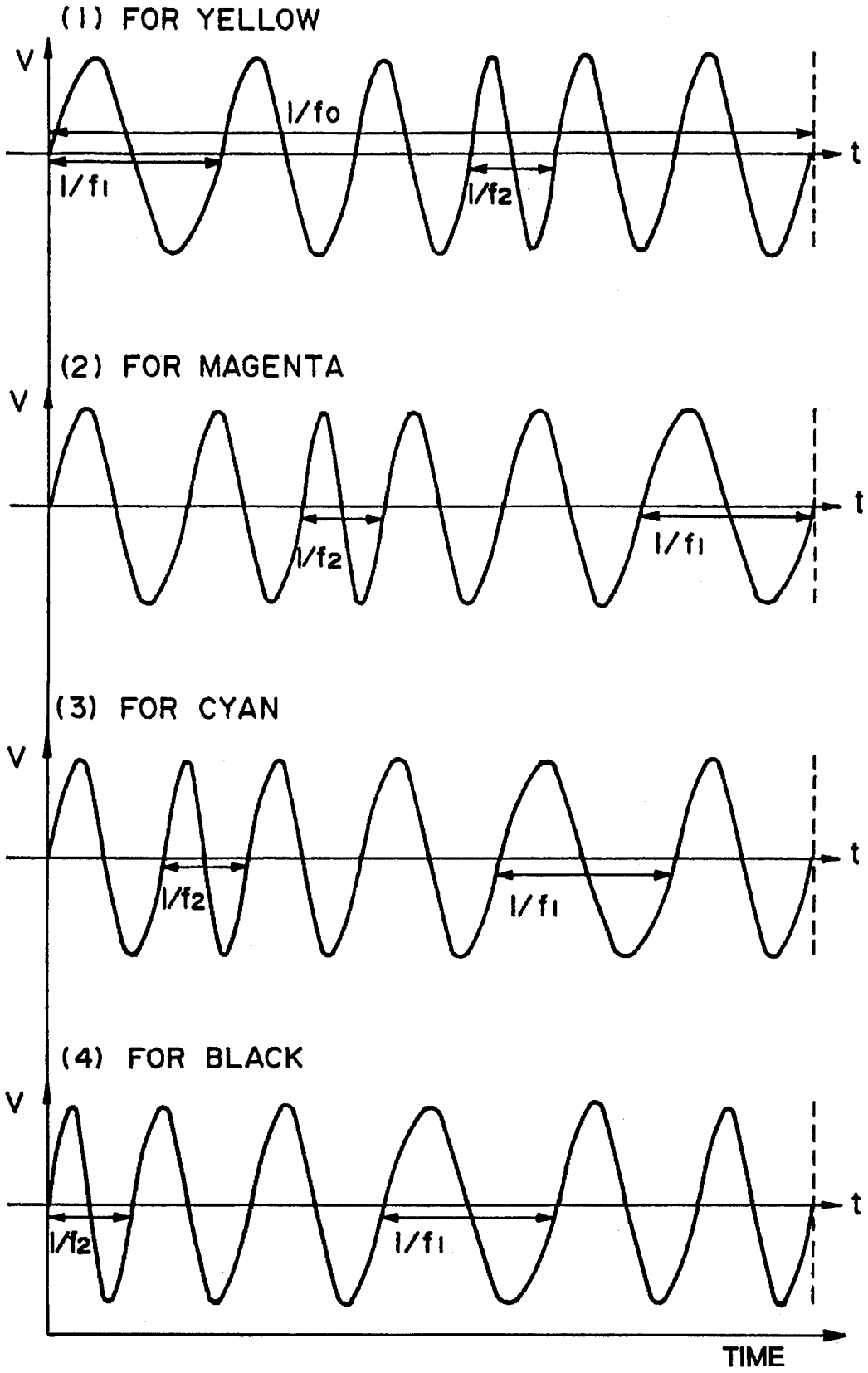
FIG. 6 shows a waveform of an applied bias voltage to the charging roller in the toner image forming process for each color, according to a third embodiment of the present invention.

Embodiment 3 (FIG. 6)

This embodiment is similar to the second embodiment (color image forming apparatus but the bias voltage applied to the charging roller 2 is changeable in the frequency, and the phase of the waveform is changed for the respective toner image formation process for the color, by which similarly to the second embodiment, the moire and the color non-uniformity is prevented in the color image.

In FIG. 5, (1), a bias waveform is shown which is supplied to the charging roller 2 in the first color yellow toner image formation process. The frequency is changed from the minimum frequency f1=300 Hz through the maximum frequency f2=600 Hz and back to the minimum frequency f1. Here, the modulation is based on one period including 6 waves.

In the case of (2), a bias waveform for the second magenta toner image formation process, is shown, in which the bias voltage shown in (1) is advanced by 1 wave.

For the third color magenta toner image formation process and fourth color black toner image formation process, a bias voltage further advanced by one wave and by one wave (3, 4) are used.

The bias voltage applied to the charging roller 2 is modulated in the frequency for each color, and the phase thereof is changed for each color toner image formation process, the images of the same frequencies are not overlaid even if four color are overlaid, and therefore, the moire and the color non-uniformity can be prevented in a color image.

In addition, in synchronism with the rotation of the transfer drum 60 or the photosensitive drum 1, the writing starting timing for the image and the phase of the charging bias may be controlled.

The color image forming apparatus may be of such a type that a plurality of color toner images are sequentially formed superimposed on an image bearing member 1, and the superimposed toner images are transferred at once onto the transfer material. Alternatively, the toner image sequentially formed on the image bearing member 1 is once sequentially transferred onto an intermediate image bearing member, and the toner image superimposedly formed on the intermediate image bearing member is transferred at once onto the transfer material.

Figure 7:
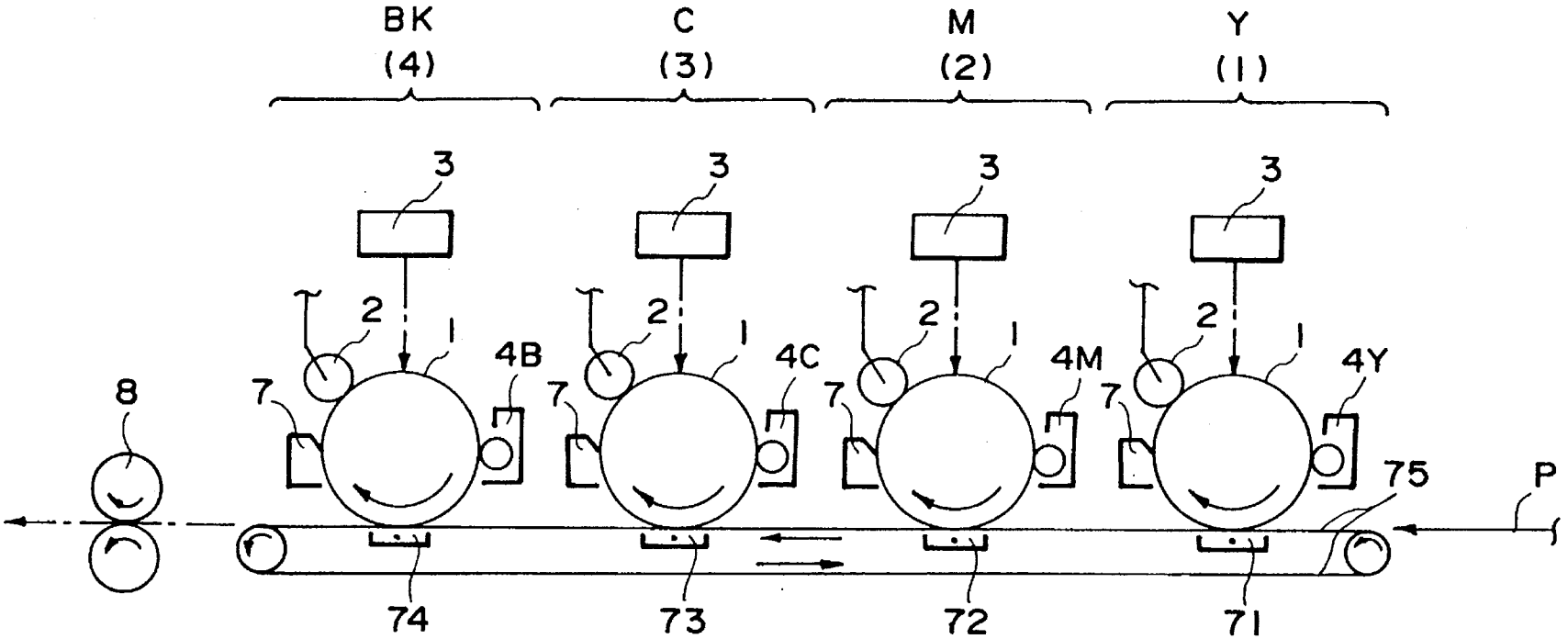
FIG. 7 is a sectional view of a color image forming apparatus according to a further embodiment of the present invention.

Further alternatively, as shown in FIG. 7, the image forming apparatus may comprise four process stations (1)–(4) for the yellow toner image, magenta toner image, cyan toner image and the black toner image, respectively. The transfer material P is sequentially fed by feeding means 75 to the transfer stations 71–74 of the respective process stations, by which the four toner images are sequentially superimposed and transferred.

In each type of the color image forming apparatuses, the color images can be produced without moire and color-non-uniformity.

The charging member may be out of contact with the image bearing member, but small air gap enough to produce electric discharge with the surface of the image bearing member. When the charging member and the image bearing member are placed close to each other, the gap therebetween is preferably not more than 1000 μm. The charging member may be a blade type, rod type, brush type or the like rather than the above-described roller type.

The waveform of the oscillating voltage applied to the charging member may be, rectangular wave, so teeth wave, triangular wave, pulse wave rather than the sine wave. In addition, the pulse wave may be produced by periodically switching the DC voltage.

As described in the foregoing, in an image forming apparatus for charging the image bearing member by applying an alternative voltage in the charger, the charging frequency is modulated during charging, by which the interference between the periodicity due to the charging of the image bearing member and the periodicity of the exposure corresponding to the image information. In a color image forming apparatus, the frequency may be changed for the repeated image formation processes, or the phase is changed, by which the same frequency images are not overlaid at the same position, and therefore, the color non-uniformity can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image bearing means for bearing an image;

charging member for sequentially charging a surface of said image bearing means to form an image thereon; and voltage application means for applying an oscillating voltage to said charging member, the oscillating voltage including a first frequency and a second frequency which is different from the first frequency, the first frequency and said second frequency are repeated for each period of the oscillating voltage.

2. An apparatus according to claim 1, wherein said oscillating voltage is in the form of a DC biased AC voltage.

3. An apparatus according to claim 1, wherein said oscillating voltage includes a plurality of different voltage waveforms having different frequencies, and a difference between a maximum and a minimum of the frequencies is not less than 50 Hz.

4. An apparatus according to claim 1, wherein said oscillating voltage includes a plurality of voltage waveforms having different frequencies, and a combined frequency of the waveforms is not more than 600 Hz.

5. An apparatus according to claim 1, further comprising transfer means for transferring the image from said image bearing means onto a transfer material, wherein the oscillating voltage includes a plurality of different voltage waveforms having different frequencies, and a combined period of said plurality of different voltage waveforms is not more than 10/Vps (sec), where Vps (mm/sec) is an image formation speed on said image bearing means.

6. An apparatus to claim 1, wherein said charging member is contactable to said image bearing means.

7. An apparatus according to claim 1, wherein said charging member is faced to said image bearing means with a small gap.

8. An apparatus according to claim 7, wherein said gap is not more than 1000 μm.

9. An apparatus according to claim 1, wherein said image bearing means is capable of bearing a first color image and a different second color image, wherein said apparatus further comprises transfer means for superimposedly transferring the first image and the second image onto a transfer material, wherein a frequency of the oscillating voltage is different between when the first image is formed and when the second image is formed.

10. An apparatus according to claim 1, wherein said image bearing means is capable of bearing a first color image and a different second color image, wherein said apparatus further comprises transfer means for superimposedly transferring the first image and the second image onto a transfer material, wherein a phase of the oscillating voltage is different between when the first image is formed and when the second image is formed.

11. An apparatus according to claim 9 or 10, wherein said image bearing means comprises one image bearing member capable of bearing first color and second color images, and said apparatus further comprises transfer material carrying means for carrying a transfer material for receiving the first and second color images.

12. An apparatus according to claim 9 or 10, wherein said image bearing means comprises a first image bearing member for bearing the first color image and a second image bearing member for bearing the second color image, and wherein said apparatus further comprises a transfer material carrying member for carrying a transfer material to receive the images from the first and second image bearing members on the transfer material.

13. An apparatus according to claim 10, wherein said image bearing means is capable of bearing yellow, magenta, cyan and black images, and a full-color image can be formed on the transfer material, and wherein the phase is changed for each color image formation.

14. An image forming apparatus comprising:

image carrying means for carrying a first color image and a second different color image;

transfer means for superimposedly transferring the first and second color images;

charging member for continuously charging a surface of said image carrying means to form the images on said image carrying means and;

voltage application means for applying an oscillating voltage to said charging member, wherein a frequency of the oscillating voltage is different between when the first color image is formed and when the second color image is formed.

15. An apparatus according to claim 14, wherein a phase of the oscillating voltage is different between when the first color image is formed and when the second color image is formed.

16. An apparatus according to claim 14, wherein the oscillating voltage is in the form of a DC biased AC voltage.

17. An apparatus according to claim 14, wherein said charging member is contactable to said image carrying means.

18. An apparatus according to claim 14, wherein said charging member is faced to said image carrying means with a small gap therebetween.

19. An apparatus according to claim 18, wherein the gap is not more than 1000 μm.

20. An apparatus according to claim 14, wherein said image carrying means comprises one image bearing member capable of carrying the first and second color images, wherein said apparatus further comprises a transfer material carrying member for carrying a transfer material to receive the images from said image carrying means onto the transfer material thereon.

21. An apparatus according to claim 14, wherein said image carrying means comprises a first image bearing member for bearing the first color image and a second image bearing member for bearing the second color image, and wherein said apparatus further comprises a transfer material carrying member for carrying a transfer material to receive the images from the first and second image bearing members on the transfer material.

22. An apparatus according to claim 14, wherein said image carrying means is capable of carrying yellow, magenta, cyan and black images, and a full-color image can be formed onto a transfer material, and wherein the frequency is changed for each color image formation.

* * * * *

UNITED STATES PATENT AND TRADEMARK OFFICE

CERTIFICATE OF CORRECTION

PATENT NO. : 5,596,393

DATED : January 21, 1997

INVENTORS : Tatsuya Kobayashi, et al.

It is certified that error appears in the above-identified patent and that said Letters Patent is hereby corrected as shown below:

COLUMN 5

Line 24, "drum I" should read --drum 1--.

COLUMN 7

Table 2, "n n(non-uniformity)" should read --N N(non-uniformity)--;
Line 23, "bas" should read --bad--; and
Line 38, "Fig. 5" should read --Fig. 6--.

COLUMN 9

Line 20, "apparatus" should read --apparatus according--.

Signed and Sealed this

Second Day of September, 1997

*Attest:*

*Attesting Officer*

BRUCE LEHMAN

*Commissioner of Patents and Trademarks*